US005261769A

United States Patent [19]

Leclerc

[11] Patent Number: 5,261,769

[45] Date of Patent: Nov. 16, 1993

[54] BOOK BINDING APPARATUS AND METHOD

[75] Inventor: Mark Leclerc, Troy, Ohio

[73] Assignee: AM International Incorporated, Chicago, Ill.

[21] Appl. No.: 925,800

[22] Filed: Aug. 4, 1992

[51] Int. Cl.[5] ..... B42C 11/00

[52] U.S. Cl. ..... 412/4; 412/20; 412/27; 412/37

[58] Field of Search ..... 412/4, 19, 20, 27, 37; 156/908; 83/152, 154

[56] References Cited

U.S. PATENT DOCUMENTS

| | | | |
|---|---|---|---|
| 1,389,762 | 9/1921 | Juengst | 412/27 |
| 2,646,104 | 7/1953 | Hawkes | 156/908 |
| 4,299,410 | 11/1981 | Jukola | 412/27 |
| 4,556,353 | 12/1985 | Ehlermann | 412/19 |

*Primary Examiner*—Paul A. Bell
*Assistant Examiner*—Kenneth S. Hansen
*Attorney, Agent, or Firm*—Tarolli, Sundheim & Covell

[57] ABSTRACT

An apparatus and method for applying a soft cover to book block is disclosed. A book block conveyor moves the book block to a cover applying station. A first adhesive applicator applies adhesive to the spine of the book block. A soft cover conveyor transports the soft cover to the covering station in a timed relationship to the book block. A crash feeder attaches crash to a first portion of the soft cover that covers a first side of the book block as the soft covers pass the crash feeder. The crash is attached to the soft cover so that the crash engages a spine portion of the cover that covers the spine of the book block but is not attached to the spine portion.

11 Claims, 3 Drawing Sheets

BOOK BINDING APPARATUS AND METHOD

BACKGROUND OF THE INVENTION

The present invention relates to an apparatus and method for attaching a soft cover to a book block. A book block is an assembly of pages forming a book.

A known book binding system includes a book block conveyor assembly having a plurality of clamps which grip book blocks. The clamps carry the book blocks to a first station where a rotary knife cuts off the folds at the backs of the book blocks. The book blocks are then sequentially conveyed to a second station where the backs of the books are roughened. At one or more gluing stations, glue is applied to the roughened backs of the books. A cover feeder sequentially feeds covers to a cover applying station in a registered relationship with the books. After the covers have been applied to the books, the books are delivered to a trimmer for suitable trimmer operations.

SUMMARY OF THE INVENTION

The present invention provides a new and improved apparatus for applying a soft cover to a book block. The apparatus includes a book block conveyor for moving the book block to a cover applying station. The cover is applied to the book block as the cover and book block move through a cover applying station. A first adhesive applicator applies adhesive to the spine of the book block A soft cover conveyor transports the soft cover to the cover applying station in a timed relationship to the book block. The cover while on the soft cover conveyor passes a crash feeder, the crash feeder attaches crash or crinkle paper to a portion of the soft cover. The crash overlies, but is not attached to, a spine portion of the soft cover that covers a spine of the book block.

The crash feeder includes a crash supply roll and a knife for cutting the crash to a desired width. A pusher wheel pushes the cut crash to a vacuum wheel after the crash is cut. The vacuum wheel has vacuum along its outer periphery which hold the cut crash against the outer periphery of the vacuum wheel until the vacuum wheel has rotated approximately 180° and then releases to release crash and transfer the crash to the passing cover. An adhesive applicator applies a first strip of adhesive to the portion of the soft cover that does not cover the spine of the book block to attach the crash to the cover.

In one embodiment of the invention, the adhesive applicator applies two strips of adhesive to the cover. The adhesive applicator applies a first strip to a first portion of the cover that covers a first side of the book block. The adhesive applicator also applies a second strip of adhesive to a second portion of the cover that covers a second side of the book block. The first and second portions of the cover do not cover the spine of the book block.

In another embodiment of the present invention, the adhesive applicator only applies a strip of adhesive to the first portion of the soft cover. Another adhesive applicator applies two strips of adhesive to each side of the book block. One strip of adhesive on each side is for attaching the crash to the sides of the book block. The other strip of adhesive on each side is for attaching the cover to the sides of the book block.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENTS OF THE PRESENT INVENTION

Figure 1:
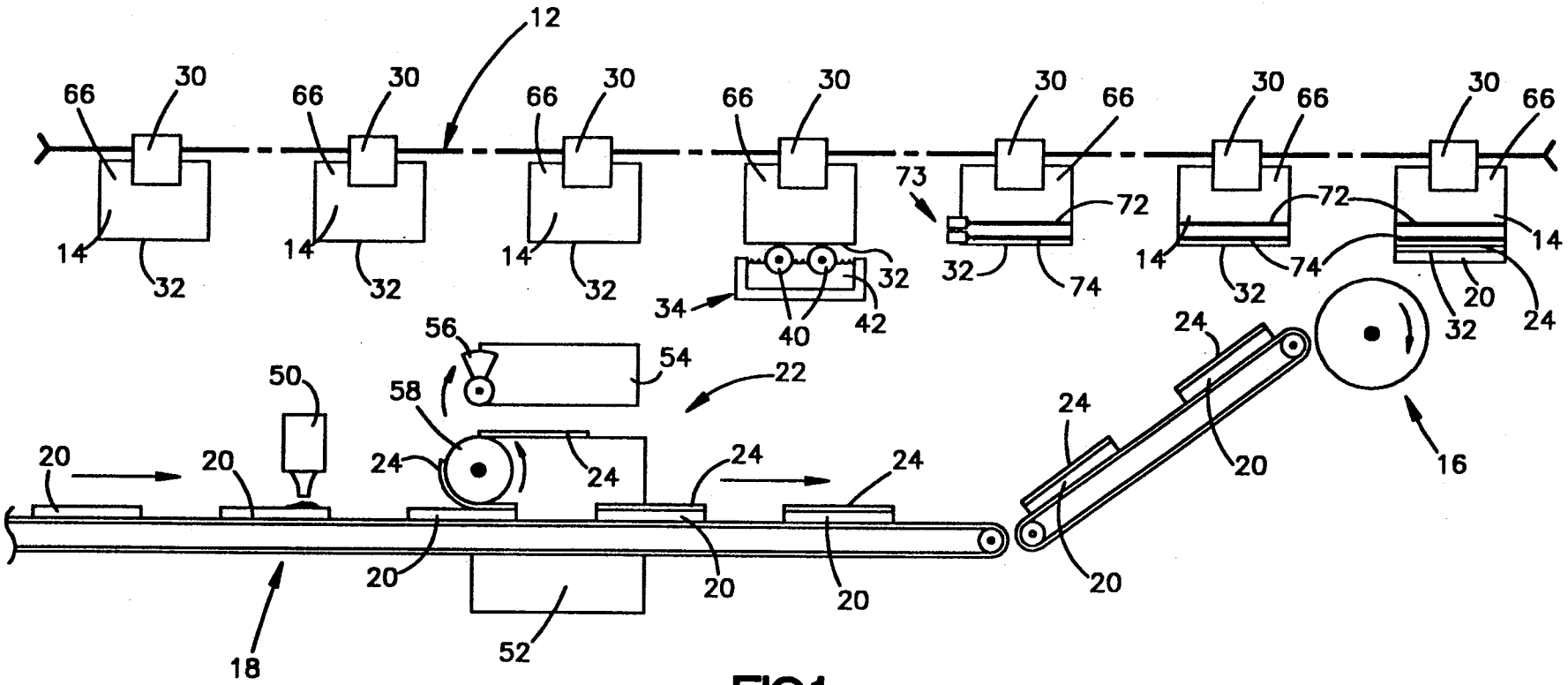
FIG. 1 is a schematic illustration of an apparatus for binding books.

An apparatus 10 for binding books is illustrated in FIG. 1. The apparatus 10 includes a book block conveyor 12 for sequentially moving book blocks 14 to a cover applying station 16. The apparatus 10 also includes a cover conveyor 18 for sequentially transporting soft covers 20 (shown with exaggerated thickness for illustration purposes in FIG. 1) past a crash feeder 22 and to the cover applying station 16. The crash feeder 22 attaches crash 24 to the covers 20 as the cover conveyor 8 sequentially transports the covers 20 past the crash feeder 22.

The book block conveyor 12 includes a plurality of clamp assemblies 30 (FIG. 1). The structure and operation of book clamps are well known in the art and, therefore, will not be described herein. The clamp assemblies 30 hold the book blocks 14 with the spines 32 of the book blocks facing downward as viewed in FIG. 1. The book block conveyor 12 sequentially transports the book blocks 14 past an adhesive applicator 34 prior to transporting the book blocks to the cover applying station 16.

Figure 3:
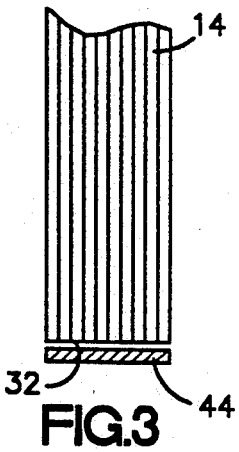
FIGS. 3–6 are schematic illustrations of a book block at different stages being processed through the apparatus of FIG. 1.

The adhesive applicator 34 may be of any suitable construction. The adhesive applicator 34 illustrated has two rollers 40 and a glue reservoir 42. The rollers 40 are partially submerged in the glue reservoir 42. As the book block conveyor 12 transports the book blocks 14 past the adhesive applicator 34, the spines 32 of the book blocks engage the rollers 40 which apply a strip of glue 44 to the spine of each of the book blocks (FIG. 3).

The cover conveyor 18 (FIGS. 1 and 2) has a glue gun 50 associated with it. The glue gun 50 applies glue to the covers 20 as the cover conveyor 18 transports the covers past the glue gun.

A base 52 (FIG. 1) of the crash feeder 22 supports a knife 54 for cutting the crash 24 to a desired width. The crash 24 is fed below the knife 54 from a supply roll 46 (FIG. 2) by feed rollers 48. The feed rollers 48 feed a desired width of the crash 24 below the knife 54. The width of the crash 24 is larger than the width of the spine 32 of the book block 14.

The knife 54 moves down, as viewed in the drawings, and cuts off the desired width of the crash 24. A rotating pusher wheel 56 engages the cut crash 24 and pushes the crash onto a vacuum wheel 58. The vacuum wheel 58 transfers the crash 24 to the passing cover 20.

The vacuum wheel 58 has vacuum provided along a portion of its outer periphery to hold the crash 24 against the outer periphery of the vacuum wheel. As the vacuum wheel 58 rotates to a position in which the crash 24 engages the cover 20, the vacuum is turned off to release the crash 24 onto the cover 20. The vacuum wheel 58 rotates at a speed such that the surface speed of the vacuum wheel is the same as the speed at which the cover conveyor 18 moves the covers 20 as the covers pass the vacuum wheel. Therefore, there is no relative movement between the covers 20 and the crash 24 as the crash is applied to the covers.

Figure 2:
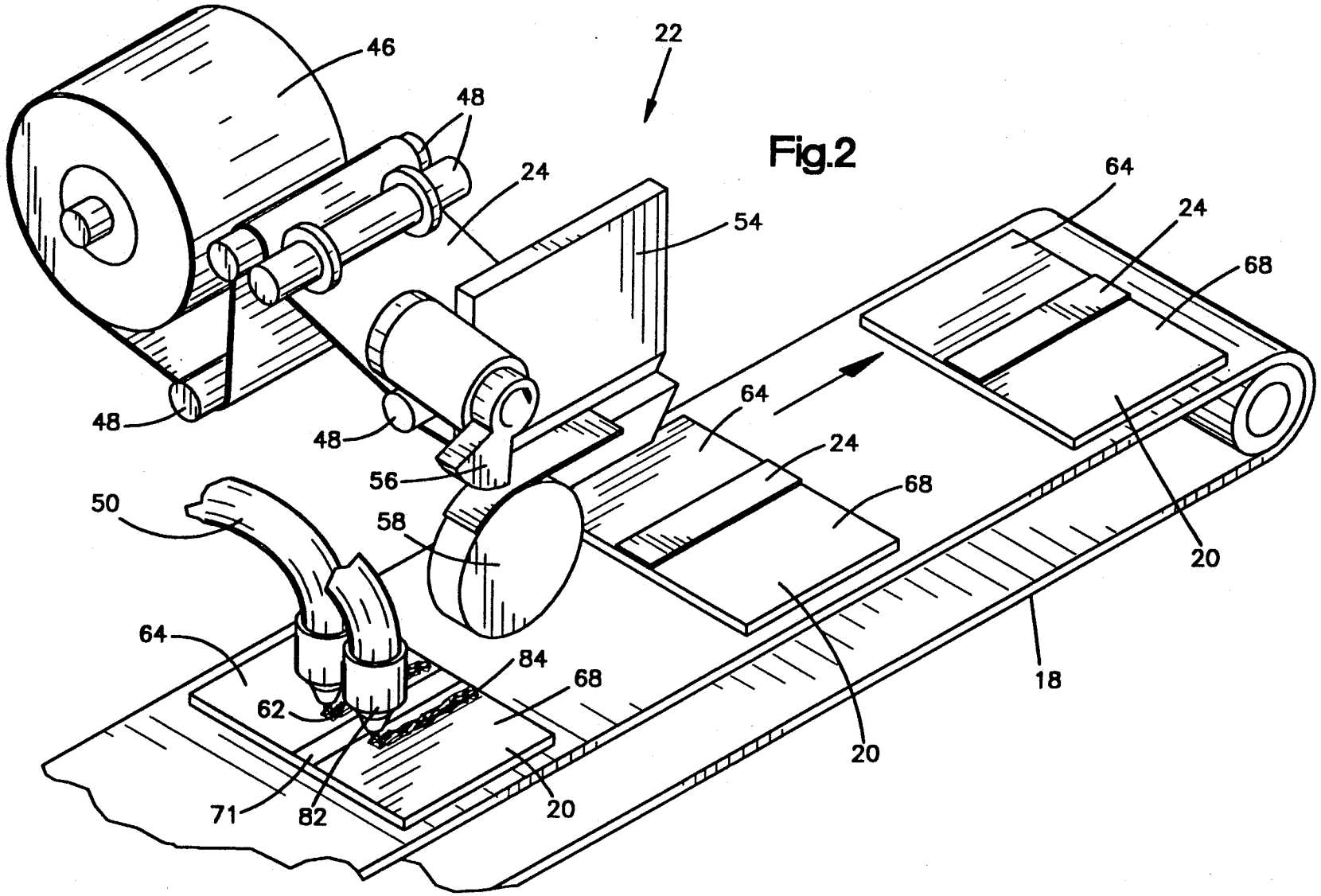
FIG. 2 is schematic illustration of a crash feeder embodied in the apparatus of FIG. 1.
Figure 4:
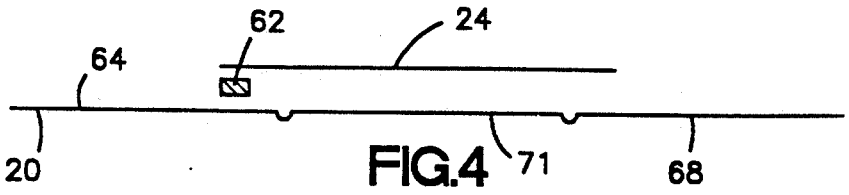

In one embodiment of the present invention, the glue gun 50 applies one strip of adhesive 62 (FIGS. 2 and 4) to the cover 20. The glue gun 50 applies the strip of adhesive 62 to a first portion 64 of the cover 20 for covering a first side 66 (FIGS. 4 and 5) of the book block 14. The cover 20 also includes a second portion 68 for covering a second side 70 of the book block 14. The cover 20 has a spine portion 71 for covering the spine 32 of the book block 14. The crash 24 engages the second portion 68 and the spine portion 71 but is not attached to the second portion or the spine portion of the cover 20 (FIGS. 2, 4 and 5).

At the cover applying station 16 the crash 24 is applied to the strip of glue 44 on the spine 32 of the book block 14. Therefore, the spine portion 71 of the cover 20 is not attached to the crash 24 or to the spine 32 of the book block 20.

Figure 5:
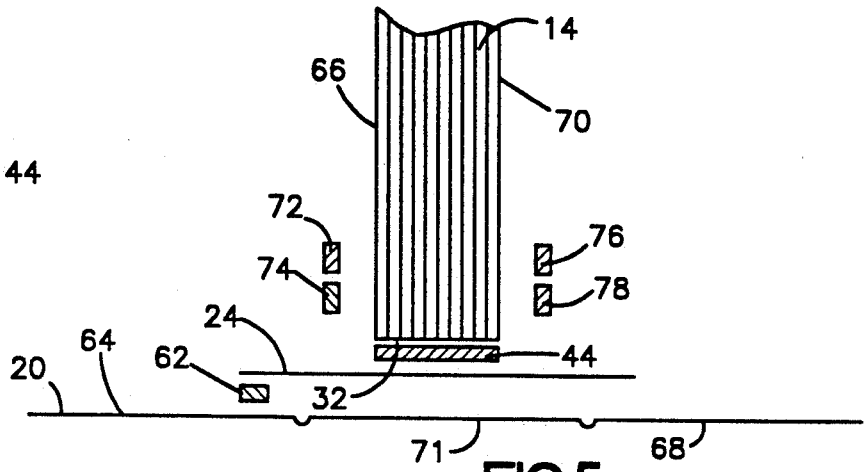
Figure 6:
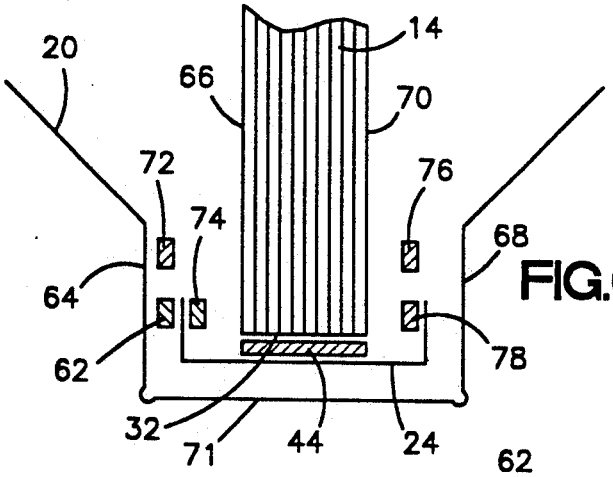

Another adhesive applicator 73 (FIG. 1) applies strips of adhesive to the sides 66 and 70 of the book block 14 (FIG. 5). The adhesive applicator 73 applies a first strip of adhesive 72 to the first side 66 of the book block 14 for attaching the first portion 64 of the cover 20 to the first side 66 of the book block (FIG. 6). The adhesive applicator 73 applies a second strip of adhesive 74 to the first side 66 of the book block 1 for attaching the crash 24 to the first side of the book block. An adhesive applicator similar to applicator 73 applies a first strip of adhesive 76 to the second side 70 of the book block 14 for attaching the second portion 68 of the cover 20 to the second side of the book block. The adhesive applicator 73 also applies a second strip of adhesive 78 to the second side 70 of the book block 14 for attaching the crash 24 to the second side of the book block.

Figure 7:
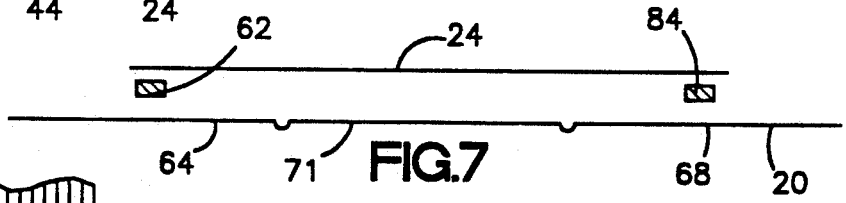
FIGS. 7 and 8 are schematic illustrations of another embodiment of the invention showing a book block in different stages of being covered.
Figure 8:
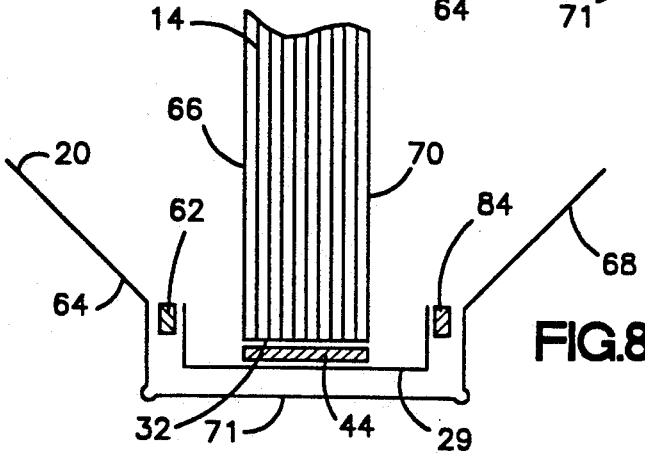

In another embodiment of the present invention (FIGS. 7 and 8), the glue gun 50 applies a first strip of adhesive 62 (FIGS. 7 and 8) to the first portion 64 of the cover 20 for covering the first side 66 of the book block 14. A glue gun 82 (FIG. 2) applies a second strip of adhesive 84 to the second portion 68 of the cover 20 for covering the second side 70 of the book block 14. The glue guns 50 and 82 do not apply any glue to the spine portion 71 of the cover 20. The crash 24 is attached to the first and second portions 64, 68 of the cover 20. The crash 24 engages the spine portion 71 but is not attached to the spine portion 71.

In both embodiments of the present invention, the spine portion 71 of the cover 20 is not attached to the crash 24 or the book block 14. The crash 24 is attached to the spine 32 of the book block 14. In this way the spine portion 71 of the cover 20 does not hinder the opening of the book.

The operation of the book binding apparatus 10 will now be described. As the cover conveyor 18 (FIG. 1) moves the covers 20 toward the cover applying station 16, the crash feeder 22 attaches crash 24 to the covers. The glue gun 50 applies one strip of adhesive 62 to each cover 20 in one embodiment of the present invention. In the other embodiment, two strips of adhesive 62 and 84 are applied to the covers 20 by the glue guns 50 and 82. In both embodiments adhesive is not applied to the spine portion 71 of the covers 20. After the adhesive is applied to the covers 20, the crash feeder 22 attaches the crash 24 to the covers.

While the cover conveyor 18 transports the covers 20 past the crash feeder 22 and to the covering station 16, the book block conveyor 12 transports book blocks 14 to the cover applying station. The book block conveyor 12 carries the book blocks 14 past the adhesive applicator 34 where the glue strip 44 is applied to the spines 32 of the book blocks 14. The book block conveyor 12 may also transport the book blocks 14 through a cutting station where folds are cut off the book blocks and through a roughening station where the spines 32 are roughened prior to the application of any adhesive. At the cover applying station 16 the crash 24, with the cover 20 attached to the crash, is attached to the spines 32 of the book blocks 14.

In the one embodiment of the present invention, four strips of adhesive 72–78 are applied to the sides 66 and 70 of the book blocks 14 as the book block conveyor 12 transports the book blocks 14 to the cover applying station 16. The four strips of adhesive 72–78 are for attaching the crash 24 and the covers 20 to the sides 66 and 70 of the book blocks 14.

From the above description of the invention, those skilled in the art will perceive improvements, changes and modifications in the invention. Such improvements, changes and modifications within the skill of the art are intended to be covered by the appended claims.

Having described the invention, the following is claimed:

1. An apparatus for applying a soft cover to a book block having first and second sides and a spine extending between and generally perpendicular to the first and second sides; the cover having a first portion for covering the first side of the book block, a second portion for covering the second side of the book block and a spine portion intermediate the first and second portions for covering the spine of the book block; said apparatus comprising:

a cover applying station;

a book block conveyor for sequentially moving the book block in a first path to said cover applying station;

a first adhesive applicator for applying adhesive to the spine of the book block as the book block is conveyed to said cover applying station;

a dover conveyor for transporting the soft cover to said cover applying station in a second path spaced from said first path;

a crash feeder adjacent said second path for attaching a piece of crash to the cover as said cover conveyor moves the cover in said second path past said crash feeder and toward said cover applying station, the crash having first and second portions and a spine portion intermediate the first and second portions of the cash, said crash feeder including means for attaching the first portion of the crash to the first portion of the cover and for maintaining the spine portion of the crash in engagement with the spine portion of the cover and unattached to the spine portion of the cover; and means for applying the spine portion of the crash, which is unattached to the spine portion of the cover, to the adhesive on the spine of the book block at said cover applying station as the book block and the cover move through said cover applying station.

2. An apparatus as set forth in claim 1 further including a second adhesive applicator for applying adhesive to the first side of the book block and to the second side of the book block as the book block is moving toward said cover applying station.

3. An apparatus as set forth in claim 2 wherein said second adhesive applicator applies four strips of adhesive to the book block, two strips of adhesive to each of the first and second sides of the book block, one of the strips of adhesive on the first side of the book block for attaching the crash to the first side, one of the strips on the second side of the book block for attaching the crash to the second side, the other of the strips of adhesive on the first side of the book block for attaching the cover to the first side and the other of the strips on the second side for attaching the cover to the second side.

4. An apparatus as set forth in claim 1 wherein said crash feeder comprises a crash supply roll, a knife for cutting the crash to a desired width, a pusher wheel for transferring the cut crash to a vacuum wheel, said vacuum wheel transferring the cut crash to the soft cover and said apparatus further comprising a third adhesive applicator for applying a first strip of adhesive to the first portion of the soft cover that covers the first side of the book block as the cover is moved past said third adhesive applicator by said cover conveyor.

5. An apparatus as set forth in claim 4 wherein said third adhesive applicator applies a second strip of adhesive to the second portion of the soft cover that covers the second side of the book block as the cover is moved past said third adhesive applicator by said cover conveyor.

6. A method of covering a book block with a soft cover, the book block having first and second sides and a spine extending between and generally perpendicular to the first and second sides; the cover having a first portion for covering the first side of the book block, a second portion for covering the second side of the book block and a spine portion for covering the spine of the book block; said method comprising the steps of:

conveying the book block along a first path;

applying adhesive to the spine of the book block as it moves along the first path;

conveying the cover along a second path spaced apart from the first path;

attaching a piece of crash to the cover as the cover is being conveyed along the second path, the crash having first and second portions and a spine portion intermediate the first and second portions, said step of attaching a piece of crash to the cover including the steps of attaching the first portion of the crash to the first portion of the cover and maintaining the spine portion of the crash in engagement with the spine portion of the cover and unattached to the spine portion of the cover; and attaching the crash, with the cover attached to the crash, to the spine of the book block by moving the spine portion of the crash which is maintained unattached to the spine portion of the cover into contact with the adhesive on the spine of the book block.

7. A method as set forth in claim 6 further including the step of applying adhesive to the first side of the book block and to the second side of the book block.

8. A method as set forth in claim 7 wherein said step of applying adhesive to the first and second sides of the book block comprises the step of applying two strips of adhesive to each of the first and second sides of the book block for attaching the crash and the soft cover to the first and second sides of the book block.

9. A method as set forth in claim 6 wherein said step of attaching crash to the soft cover includes the step of cutting the crash to a desired width and the step of applying a first strip of adhesive to the first portion of the soft cover.

10. A method as set forth in claim 9 wherein said step of applying a first strip of adhesive includes the step of applying a second strip of adhesive to the second portion of the soft cover that covers the second side of the book block when the cover is attached to the book block.

11. An apparatus for applying a soft cover to a book block having first and second sides and a spine extending between and generally perpendicular to the first and second sides; the cover having a first portion for covering the first side of the book block, a second portion for covering the second side of the book block and a spine portion intermediate the first and second portions for covering the spine of the book block; said apparatus comprising:

a cover applying station;

a book block conveyor for sequentially moving the book block in a first path to said cover applying station;

a first adhesive applicator for applying adhesive to the spine of the book block as the book block is conveyed to said cover applying station;

a cover conveyor for transporting the soft cover to said cover applying station in a second path spaced from said first path;

a crash feeder adjacent said second path for attaching a piece of crash to the cover as said cover conveyor moves the cover in said second path past said crash feeder and toward said cover applying station, the crash having first and second portions and a spine portion intermediate the first and second portions of the crash, said crash feeder including means for attaching the first portion of the crash to the first portion of the cover, means for attaching the second portion of the crash to the second portion of the cover, and means for maintaining the spine portion of the crash in engagement with the spine portion of the cover and unattached to the spine portion of the cover; and means for applying the spine portion of the crash, which is unattached to the spine portion of the cover, to the adhesive on the spine of the book block at said cover applying station as the book block and the cover move through said cover applying station.

* * * * *

UNITED STATES PATENT AND TRADEMARK OFFICE

CERTIFICATE OF CORRECTION

PATENT NO. : 5,261,769

DATED : November 16, 1993

INVENTOR(S) : Mark Leclerc

It is certified that error appears in the above-identified patent and that said Letters Patent is hereby corrected as shown below:

Column 4, line 50, change "dover" to --cover--.

Column 4, line 59, change "cash" to --crash--.

Signed and Sealed this

Third Day of May, 1994

Bruce Lehman

*Attest:*

BRUCE LEHMAN

*Attesting Officer*

*Commissioner of Patents and Trademarks*